US006083245A

United States Patent [19]

Hudson

[11] Patent Number: 6,083,245

[45] Date of Patent: Jul. 4, 2000

[54] TEETHING DEVICE

[76] Inventor: Mary A. Hudson, Rte. 2, Box 73, Bosworth, Mo. 64623

[21] Appl. No.: 09/325,279

[22] Filed: Jun. 3, 1999

[51] Int. Cl.[7] ..... A61J 17/00

[52] U.S. Cl. ..... 606/235; 606/234

[58] Field of Search ..... 606/235, 234, 606/236

[56] References Cited

U.S. PATENT DOCUMENTS

| | | | |
|---|---|---|---|
| 5,048,143 | 9/1991 | Carroll | 15/110 |
| 5,160,344 | 11/1992 | Werton | 606/235 |
| 5,284,490 | 2/1994 | Green | 606/235 |
| 5,291,878 | 3/1994 | Lombardo et al. | 128/62 |
| 5,334,218 | 8/1994 | Johnson | 606/235 |
| 5,766,223 | 6/1998 | Johnson | 606/235 |

*Primary Examiner*—Michael Buiz
*Assistant Examiner*—Anthony King
*Attorney, Agent, or Firm*—Joseph N. Breaux

[57] ABSTRACT

A device including a teething structure having a set of ridges formed thereon that is positionable into the molar region of the infant's gums and a second set of massaging ridges that is positionable between the front teeth region of the infant's gums.

2 Claims, 1 Drawing Sheet

TEETHING DEVICE

TECHNICAL FIELD

The present invention relates to infant teething devices and more particularly to a teething device that includes a clear, flexible plastic, non-toxic gel filled, center section having a circular first end and tapering away from the circular first end to a flat second end; a number of spaced, elongated gum massage ridges formed on an exterior surface of the center section between the circular first end and the flat second end and oriented perpendicularly to the flat second edge of the center section; a gripping aperture provided through the center section adjacent to the flat second end creating a gripping handle; and a frustro-conical shaped teething structure permanently attached to a domed shaped end surface of the circular first end and having a number of spaced teething ridges running from the base end thereof to the tip end thereof.

BACKGROUND ART

Infants can often benefit from having a teething device which to chew against when cutting teeth. Because the infant can be cutting teeth in various places along its gums, it would be a benefit to have teething device that included a teething structure having a set of ridges formed thereon that could be sucked into the mouth and positioned between the molar region of the infant's gums and a second set of massaging ridges that could be positioned between the front teeth region of the infant's gums.

GENERAL SUMMARY DISCUSSION OF INVENTION

It is thus an object of the invention to provide a teething device that includes a teething structure having a set of ridges formed thereon that is positionable into the molar region of the infant's gums and a second set of massaging ridges that is positionable between the front teeth region of the infant's gums It is a further object of the invention to provide a teething device that includes a flexible plastic, non-toxic gel filled, center section having a circular first end and tapering away from the circular first end to a flat second end; a number of spaced, elongated gum massage ridges formed on an exterior surface of the center section between the circular first end and the flat second end and oriented perpendicularly to the flat second edge of the center section; a gripping aperture provided through the center section adjacent to the flat second end creating a gripping handle; and a frustro-conical shaped teething structure permanently attached to a domed shaped end surface of the circular first end and having a number of spaced teething ridges running from the base end thereof to the tip end thereof.

It is a still further object of the invention to provide a teething device that accomplishes all or some of the above objects in combination.

Accordingly, a teething device is provided. The teething device includes a flexible plastic, non-toxic gel filled, center section having a circular first end and tapering away from the circular first end to a flat second end; a number of spaced, elongated gum massage ridges formed on an exterior surface of the center section between the circular first end and the flat second end and oriented perpendicularly to the flat second edge of the center section; a gripping aperture provided through the center section adjacent to the flat second end creating a gripping handle; and a frustro-conical shaped teething structure permanently attached to a domed shaped end surface of the circular first end and having a number of spaced teething ridges running from the base end thereof to the tip end thereof.

BRIEF DESCRIPTION OF DRAWINGS

For a further understanding of the nature and objects of the present invention, reference should be made to the following detailed description, taken in conjunction with the accompanying drawings, in which like elements are given the same or analogous reference numbers and wherein.

EXEMPLARY MODE FOR CARRYING OUT THE INVENTION

Figure 1:
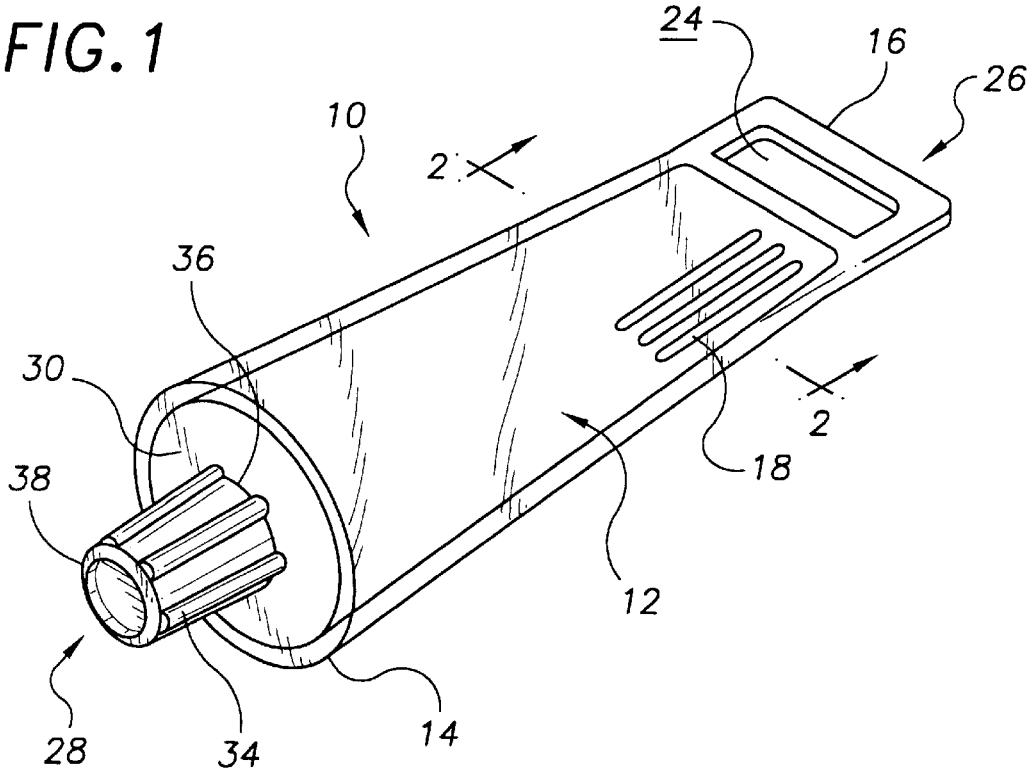
FIG. 1 is a perspective view of an exemplary embodiment of the teething device of the present invention showing the clear, flexible plastic, non-toxic gel filled, center section having a circular first end and tapering away from the circular first end to a flat second end; a number of spaced, elongated gum massage ridges formed on the exterior of the center section between the circular first end and the flat second end and oriented perpendicularly to the flat second edge of the center section; a gripping aperture provided through the center section adjacent to the flat second end creating a gripping handle; and a frustro-conical shaped teething structure permanently attached to a domed shaped end surface of the circular first end and having a number of spaced teething ridges running from the base end thereof to the tip end thereof.
Figure 2:
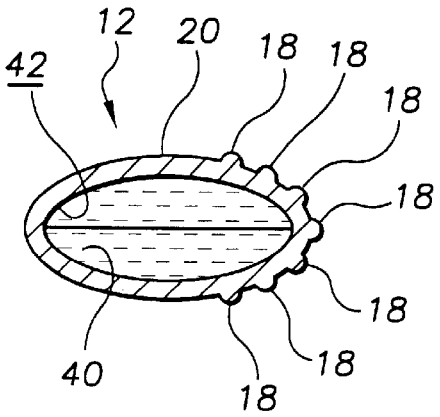
FIG. 2 is a section view through the line 2—2 of FIG. 1 showing the non-toxic gel positioned within the gel cavity of the center section and the elongated gum massage ridges formed on the exterior of the center section.

FIG. 1 shows an exemplary embodiment of the teething device of the present invention generally designated 10. Teething device 10 includes a clear, flexible plastic, non-toxic gel filled, center section, generally designated 12, having a circular first end 14 and tapering away from the circular first end 14 to a flat second end 16. Circular center section 12 has a number of spaced, elongated gum massage ridges 18 formed, with reference to now to FIG. 2, on and extending outwardly from an exterior surface 20 of center section 12 between circular first end 14 and flat second end. FIG. 2 also shows the non-toxic gel 40 positioned within the gel cavity 42 formed within center section 12. Referring back to FIG. 1, gum massage ridges 18 are oriented perpendicularly to flat second end 16 of center section 12 and, in use, are positioned between the front teeth areas of the infant's gums.

Figure 3:
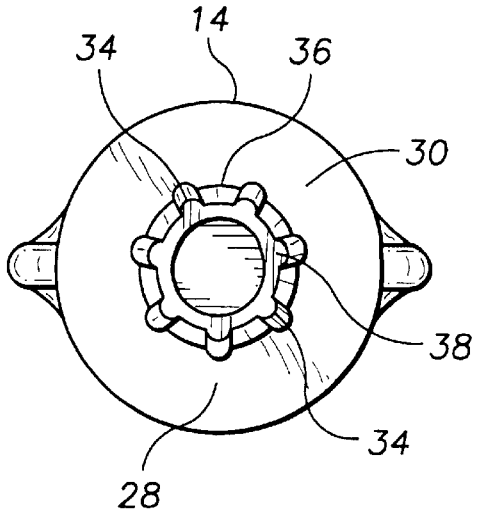
FIG. 3 is an end plan view of the teething device showing the dome-shaped end surface of the circular first end of the center section and the frustro-conical shaped teething structure permanently attached to a domed shaped end surface of the circular first end including the spaced teething ridges running from the base end thereof to the tip end thereof.

A gripping aperture 24 is provided through center section 12 adjacent to flat second end 16 creating a gripping handle, generally designated 26. A frustro-conical shaped teething structure, generally designated 28, is permanently attached to a domed shaped end surface 30, of circular first end 14 and having a number of spaced teething ridges 34 (see also FIG. 3) running from larger diameter base end 36 thereof to a smaller diameter tip end 38 thereof. In use, teething structure 28 is insertable by the infant into the mouth and positionable between the molar areas of the infant's gums.

It can be seen from the preceding description that a teething device has been provided that includes a teething structure having a set of ridges formed thereon that is positionable into the molar region of the infant's gums and a second set of massaging ridges that is positionable between the front teeth region of the infant's gums; and that includes a flexible plastic, non-toxic gel filled, center section having a circular first end and tapering away from the circular first end to a flat second end; a number of spaced, elongated gum massage ridges formed on an exterior surface of the center section between the circular first end and the flat second end and oriented perpendicularly to the flat second end of the center section; a gripping aperture provided through the center section adjacent to the flat second end creating a gripping handle; and a frustro-conical shaped teething structure permanently attached to a domed shaped end surface of the circular first end and having a number of spaced teething ridges running from the base end thereof to the tip end thereof.

It is noted that the embodiment of the teething device described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A teething device comprising:

a flexible plastic, non-toxic gel filled, center section having a circular first end and tapering away from the circular first end to a flat second end;

a number of spaced, elongated gum massage ridges formed on an exterior surface of the center section between the circular first end and the flat second end and oriented perpendicularly to the flat second end of the center section;

a gripping aperture formed through the center section adjacent to the flat second end creating a gripping handle; and a frustro-conical shaped teething structure permanently attached to a domed shaped end surface of the circular first end and having a number of spaced teething ridges running from the base end thereof to the tip end thereof.

2. The teething device of claim 1 wherein:

said center section is formed from a transparent plastic.

* * * * *